US006439307B1

(12) United States Patent
Reinhardt

(10) Patent No.: US 6,439,307 B1
(45) Date of Patent: Aug. 27, 2002

(54) APPARATUS AND METHOD FOR CONTROLLING WELL FLUID SAMPLE PRESSURE

(75) Inventor: Paul Andrew Reinhardt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 6 days.

(21) Appl. No.: 09/648,410

(22) Filed: Aug. 25, 2000

Related U.S. Application Data

(63) Continuation-in-part of application No. 09/257,292, filed on Feb. 25, 1999.

(51) Int. Cl.[7] ..... E21B 49/08
(52) U.S. Cl. ..... 166/264; 166/169; 73/864.63
(58) Field of Search ..... 166/163, 169, 166/264; 73/132.24, 864, 864.63

(56) References Cited

U.S. PATENT DOCUMENTS

| | | | | |
|---|---|---|---|---|
| 4,583,595 A | | 4/1986 | Czernichow et al. | |
| 4,721,157 A | | 1/1988 | Berzin | |
| 4,766,955 A | | 8/1988 | Petermann | |
| 4,903,765 A | | 2/1990 | Zunkel | |
| 5,009,100 A | | 4/1991 | Gruber et al. | |
| 5,240,072 A | | 8/1993 | Schultz et al. | |
| 5,303,775 A | | 4/1994 | Michaels et al. | |
| 5,322,120 A | | 6/1994 | Boe et al. | |
| 5,329,811 A | | 7/1994 | Schultz et al. | |
| 5,337,822 A | | 8/1994 | Massie et al. | |
| 5,361,839 A | | 11/1994 | Griffith et al. | |
| 5,377,755 A | | 1/1995 | Michaels et al. | 166/264 |
| 5,473,939 A | | 12/1995 | Leder et al. | 73/155 |
| 5,609,205 A | | 3/1997 | Massie et al. | 166/163 |
| 5,662,166 A | | 9/1997 | Shammai | |
| 5,708,220 A | | 1/1998 | Burge | |
| 6,065,355 A | * | 5/2000 | Schultz | 73/864 |
| 6,189,392 B1 | * | 2/2001 | Schultz | 73/864 |

FOREIGN PATENT DOCUMENTS

| | | |
|---|---|---|
| EP | 0903464 A2 | 3/1999 |
| GB | WO 96/12088 | 4/1996 |

* cited by examiner

*Primary Examiner*—William Neuder
(74) *Attorney, Agent, or Firm*—Madan, Mossman & Sriram, P.C.

(57) ABSTRACT

An apparatus and method for maintaining the pressure of a well fluid sample as the sample is transported to the well surface from a downhole wellbore location. The invention collects a formation fluid sample under pressure. The fluid sample is further pressurized with a traveling piston powered by the hydrostatic wellbore pressure. The pressurized formation fluid sample is contained under high pressure within a fixed volume chamber for retrieval to the well surface. Multiple collection tanks can be lowered into the wellbore during the same run to sample different zones with minimal rig time. The tanks can be emptied at the well surface with an evacuation pressure so that the fluid sample pressure is maintained above a selected pressure at all times.

35 Claims, 12 Drawing Sheets

APPARATUS AND METHOD FOR CONTROLLING WELL FLUID SAMPLE PRESSURE

CROSS-REFERENCE TO RELATED APPLICATION

The present application is a Continuation-In-Part of U.S. patent application Ser. No. 09/257,292 filed Feb. 25, 1999.

BACKGROUND OF THE INVENTION

1. Field of the Invention

The present invention relates to the art of earth boring and the collection of formation fluid samples from a wellbore. More particularly, the invention relates to methods and apparatus for collecting a deep well formation sample and preserving the in situ constituency of the sample upon surface retrieval.

2. Description of Related Art

Earth formation fluids in a hydrocarbon producing well typically comprise a mixture of oil, gas, and water. The pressure, temperature and volume of formation fluids control the phase relation of these constituents. In a subsurface formation, high well fluid pressures often entrain gas within the oil above the bubble point pressure. When the pressure is reduced, the entrained or dissolved gaseous compounds separate from the liquid phase sample. The accurate measure of pressure, temperature, and formation fluid composition from a particular well affects the commercial interest in producing fluids available from the well. The data also provides information regarding procedures for maximizing the completion and production of the respective hydrocarbon reservoir.

Certain techniques analyze the well fluids downhole in the wellbore. U.S. Pat. No. 5,361,839 to Griffith et al. (1993) disclosed a transducer for generating an output representative of fluid sample characteristics downhole in a wellbore. U.S. Pat. No. 5,329,811 to Schultz et al. (1994) disclosed an apparatus and method for assessing pressure and volume data for a downhole well fluid sample.

Other techniques capture a well fluid sample for retrieval to the surface. U.S. Pat. No. 4,583,595 to Czenichow et al. (1986) disclosed a piston actuated mechanism for capturing a well fluid sample. U.S. Pat. No. 4,721,157 to Berzin (1988) disclosed a shifting valve sleeve for capturing a well fluid sample in a chamber. U.S. Pat. No. 4,766,955 to Petermann (1988) disclosed a piston engaged with a control valve for capturing a well fluid sample, and U.S. Pat. No. 4,903,765 to Zunkel (1990) disclosed a time delayed well fluid sampler. U.S. Pat. No. 5,009,100 to Gruber et al. (1991) disclosed a wireline sampler for collecting a well fluid sample from a selected wellbore depth, U.S. Pat. No. 5,240,072 to Schultz et al. (1993) disclosed a multiple sample annulus pressure responsive sampler for permitting well fluid sample collection at different time and depth intervals, and U.S. Pat. No. 5,322,120 to Be et al. (1994) disclosed an electrically actuated hydraulic system for collecting well fluid samples deep in a wellbore.

Temperature downhole in a deep wellbore often exceed 300 degrees F. When a hot formation fluid sample is retrieved to the surface at 70 degrees F., the resulting drop in temperature causes the formation fluid sample to contract. If the volume of the sample is unchanged, such contraction substantially reduces the sample pressure. A pressure drop changes in the situ formation fluid parameters, and can permit phase separation between liquids and gases entrained within the formation fluid sample. Phase separation significantly changes the formation fluid characteristics, and reduces the ability to evaluate the actual properties of the formation fluid.

To overcome this limitation, various techniques have been developed to maintain pressure of the formation fluid sample. U.S. Pat. No. 5,337,822 to Massie et al. (1994) pressurized a formation fluid sample with a hydraulically driven piston powered by a high pressure gas. Similarly, U.S. Pat. No. 5,662,166 to Shammai (1997) used a pressurized gas to charge the formation fluid sample. U.S. Pat. Nos. 5,303,775 (1994) and 5,377,755 (1995) to Michaels et al. disclosed a bi-directional, positive displacement pump for increasing the formation fluid sample pressure above the bubble point so that subsequent cooling did not reduce the fluid pressure below the bubble point.

Existing techniques for maintaining the sample formation pressure are limited by many factors. Pretension or compression springs are not suitable because the required compression forces require extremely large springs. Shear mechanisms are inflexible and do not easily permit multiple sample gathering at different locations within the wellbore. Gas charges can lead to explosive decompression of seals and sample contamination. Gas pressurization systems require complicated systems including tanks, valves and regulators which are expensive, occupy space in the narrow confines of a wellbore, and require maintenance and repair. Electrical or hydraulic pumps require surface control and have similar limitations.

Accordingly, there is a need for an improved system capable of compensating for hydrostati wellbore pressure loss so that a formation fluid sample can be retrieved to the well surface at substantially the original formation pressure. The system should be reliable and should be capable of collecting the samples from the different locations within a wellbore.

SUMMARY OF THE INVENTION

The present invention provides an apparatus and method for controlling the pressure of a pressurized wellbore fluid sample collected downhole in an earth boring. The apparatus comprises a housing having a hollow interior. A compound piston within the housing interior defines a fluid sample chamber wherein the piston is moveable within the housing interior to selectively change the fluid sample chamber volume. The compound piston comprises an outer sleeve and an inner sleeve moveable relative to the outer sleeve. However, movement of the inner sleeve relative to the outer sleeve is unidirectional. An external pump extracts formation fluid for delivery under pressure into the fluid sample chamber. A positioned opened valve permits pressurized wellbore fluid to move said piston for pressurizing the fluid sample within the fluid sample chamber so that the fluid sample remains pressurized when the fluid sample is moved to the well surface.

The method of the invention is practiced by lowering a housing into a wellbore. The compound piston is displaced within the sample chamber by formation fluid delivered by the external pump. When the sample chamber has filled, a valve is opened to introduce wellbore fluid at hydrostatic wellbore pressure against the piston to move the piston for pressurizing the well fluid sample within the fluid sample chamber. By means of piston area differential, force on a inner sleeve of the compound piston is unbalanced to compress the fluid sample by a volumetric reduction. The reduced volume is secured by mechanically securing the relative positions of the compound piston against the sample chamber.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which.

DESCRIPTION OF THE PREFERRED EMBODIMENTS

Figure 1:
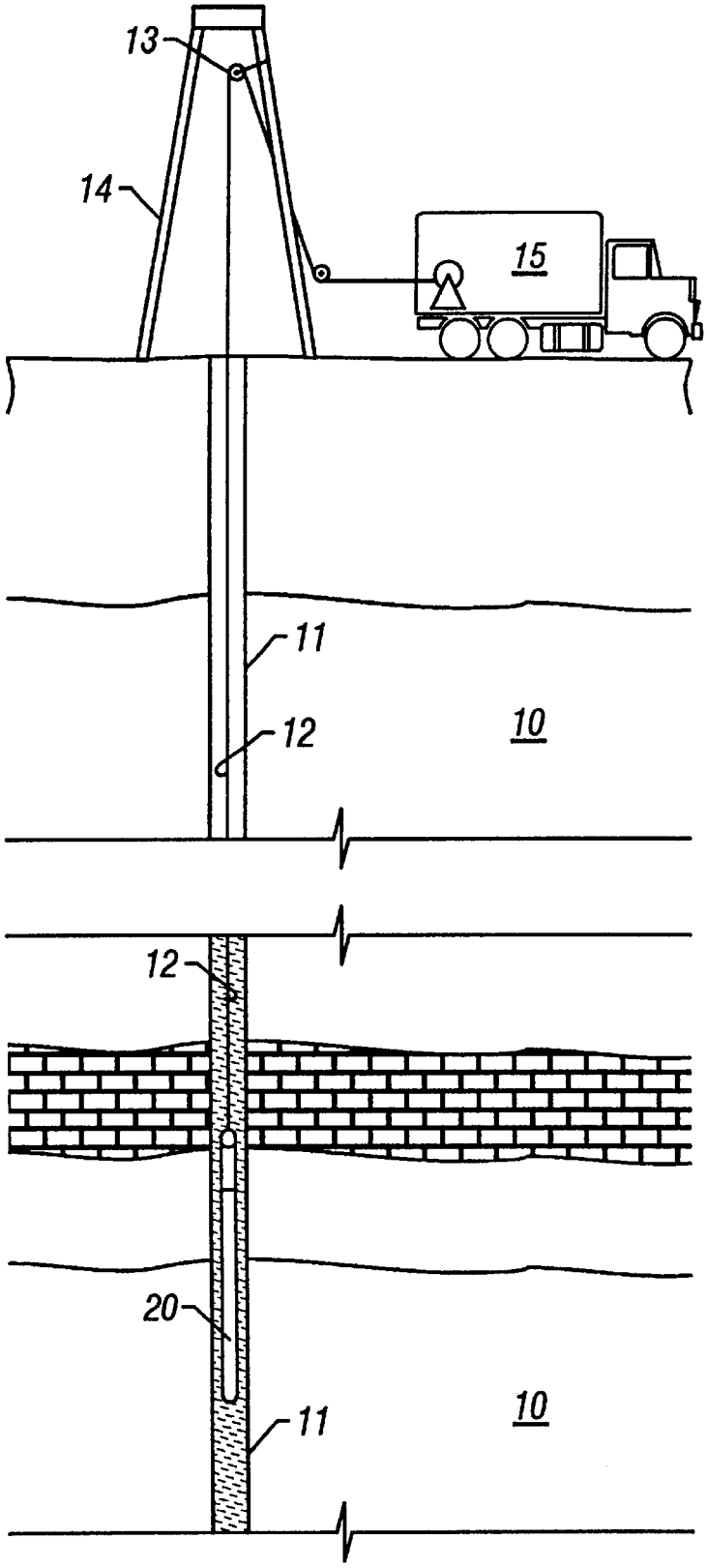
FIG. 1 is a schematic earth section illustrating the invention operating environment.

FIG. 1 schematically represents a cross-section of earth 10 along the length of a wellbore penetration 11. Usually, the wellbore will be at least partially filled with a mixture of liquids including water, drilling fluid, and formation fluids that are indigenous to the earth formations penetrated by the wellbore. Hereinafter, such fluid mixtures are referred to as "wellbore fluids". The term "formation fluid" hereinafter refers to a specific formation fluid exclusive of any substantial mixture or contamination by fluids not naturally present in the specific formation.

Suspended within the wellbore 11 at the bottom end of a wireline 12 is a formation fluid sampling tool 20. The wireline 12 is often carried over a pulley 13 supported by a derrick 14. Wireline deployment and retrieval is performed by a powered winch carried by a service truck 15, for example.

Figure 2:
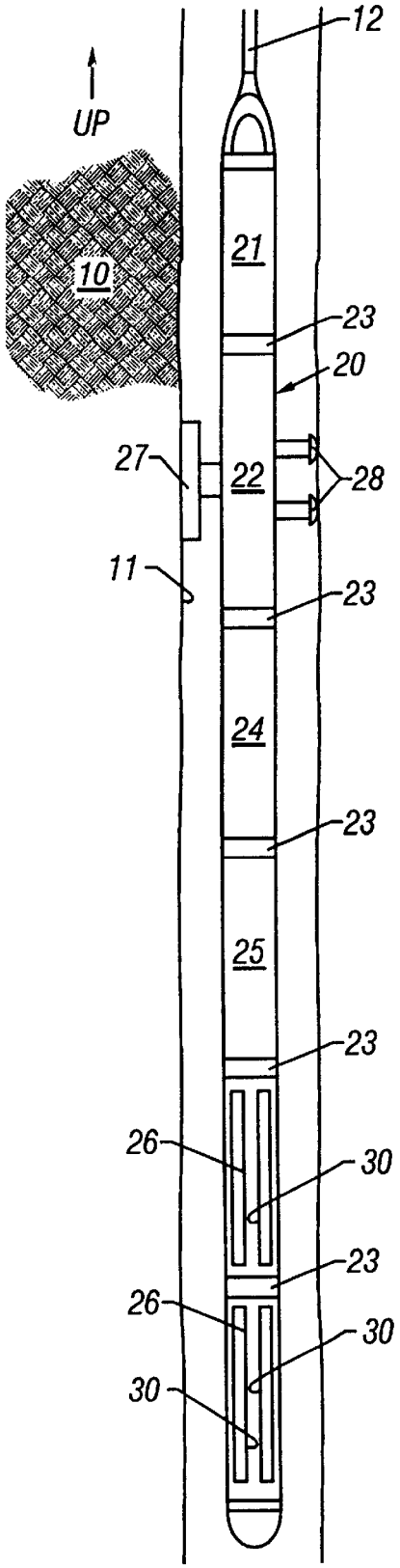
FIG. 2 is a schematic of the invention in operative assembly with cooperatively supporting tools.

Pursuant to the present invention, a preferred embodiment of a sampling tool 20 is schematically illustrated by FIG. 2. Preferably, such sampling tools are a serial assembly of several tool segments that are joined end-to-end by the threaded sleeves of mutual compression unions 23. An assembly of tool segments appropriate for the present invention may include a hydraulic power unit 21 and a formation fluid extractor 22. Below the extractor 22, a large displacement volume motor/pump unit 24 is provided for line purging. Below the large volume pump is a similar motor/pump unit 25 having a smaller displacement volume that is quantitatively monitored as described more expansively with respect to FIG. 3. Ordinarily, one or more tank magazine sections 26 are assembled below the small volume pump. Each magazine section 26 may have three or more fluid sample tanks 30.

The formation fluid extractor 22 comprises an extensible suction probe 27 that is opposed by borewall feet 28. Both, the suction probe 27 and the opposing feet 28 are hydraulically extensible to firmly engage the wellbore walls. Construction and operational details of the fluid extraction tool 22 are more expansively described by U.S. Pat. No. 5,303,775, the specification of which is incorporated herewith.

Operation of the tool is fundamentally powered by electricity delivered from the service truck 15 along the wireline 12 to the hydraulic power supply unit 21. With respect to FIG. 3, the constituency of the hydraulic power supply unit 21 comprises an A.C. motor 32 coupled to drive a positive displacement, hydraulic power pump 34. The hydraulic power pump energizes a closed loop hydraulic circuit 36. The hydraulic circuit is controlled, by a solenoid actuated 4-way valve 47, for example, to drive the motor section 42 of an integrated, positive displacement, pump/motor unit 25. The pump portion 44 of the pump/motor unit 25 is monitored by means such as a rod position sensor 46, for example, to report the pump displacement volume. Formation fluid drawn through the suction probe 27, is directed by a solenoid controlled valve 48 to alternate chambers of the pump 44 and to a tank distributor 49. By this route, sample volumes of selected formation fluid is extracted directly from respective in situ formations and delivered to designated sample chambers among the several sample tank tools 30.

As sub-steps in the formation fluid extraction procedure of the present invention, the large volume motor/pump unit 24 is employed to purge the formation fluid flow lines between the suction probe 27 and the small volume pump 25. Since these sub-steps do not require accurate volumetric data, measurement of the pump displacement volume is not required. Otherwise, the motor/pump unit 24 may be substantially the same as motor/pump unit 25 except for the preference that the pump of unit 24 has a greater displacement volume capacity.

Figure 4:
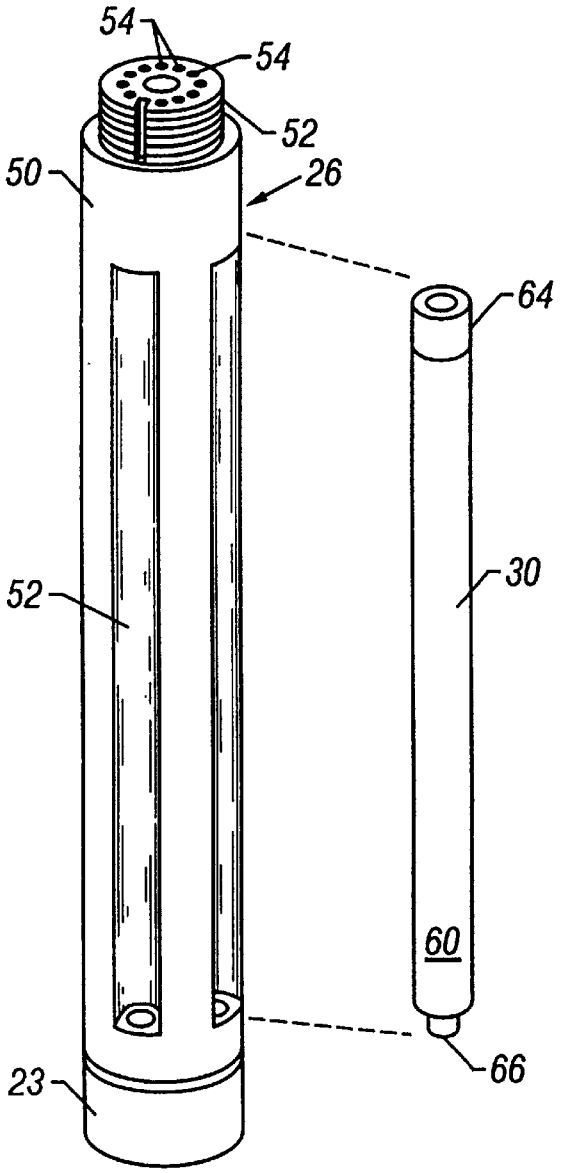
FIG. 4 is an isometric view of a sampling tank magazine.

A representative magazine section 26 is illustrated by FIG. 4 to include a fluted cylinder 50. Preferably, the cylinder 50 is fabricated to accommodate three or four tanks 30. Each tank 30 is operatively loaded into a respective alcove 52 with a bayonet-stab fit. Two or more cylinders 50 are joined by an internally threaded sleeve 23 that is axially secured to one end of one cylinder but freely rotatable about the cylinder axis. The sleeve 23 is turned upon the external threads of a mating joint boss 52 to draw the boss into a compression sealed juncture therebetween whereby the fluid flow conduits 54 drilled into the end of each boss 52 are continuously sealed across the joint.

Figure 5:
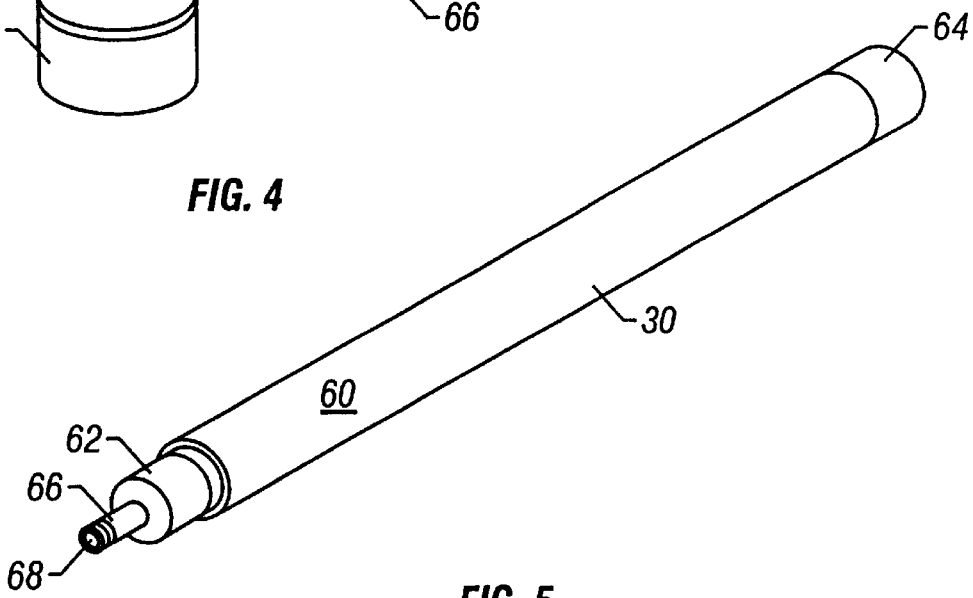
FIG. 5 is an isometric view of the present invention.
Figure 6:
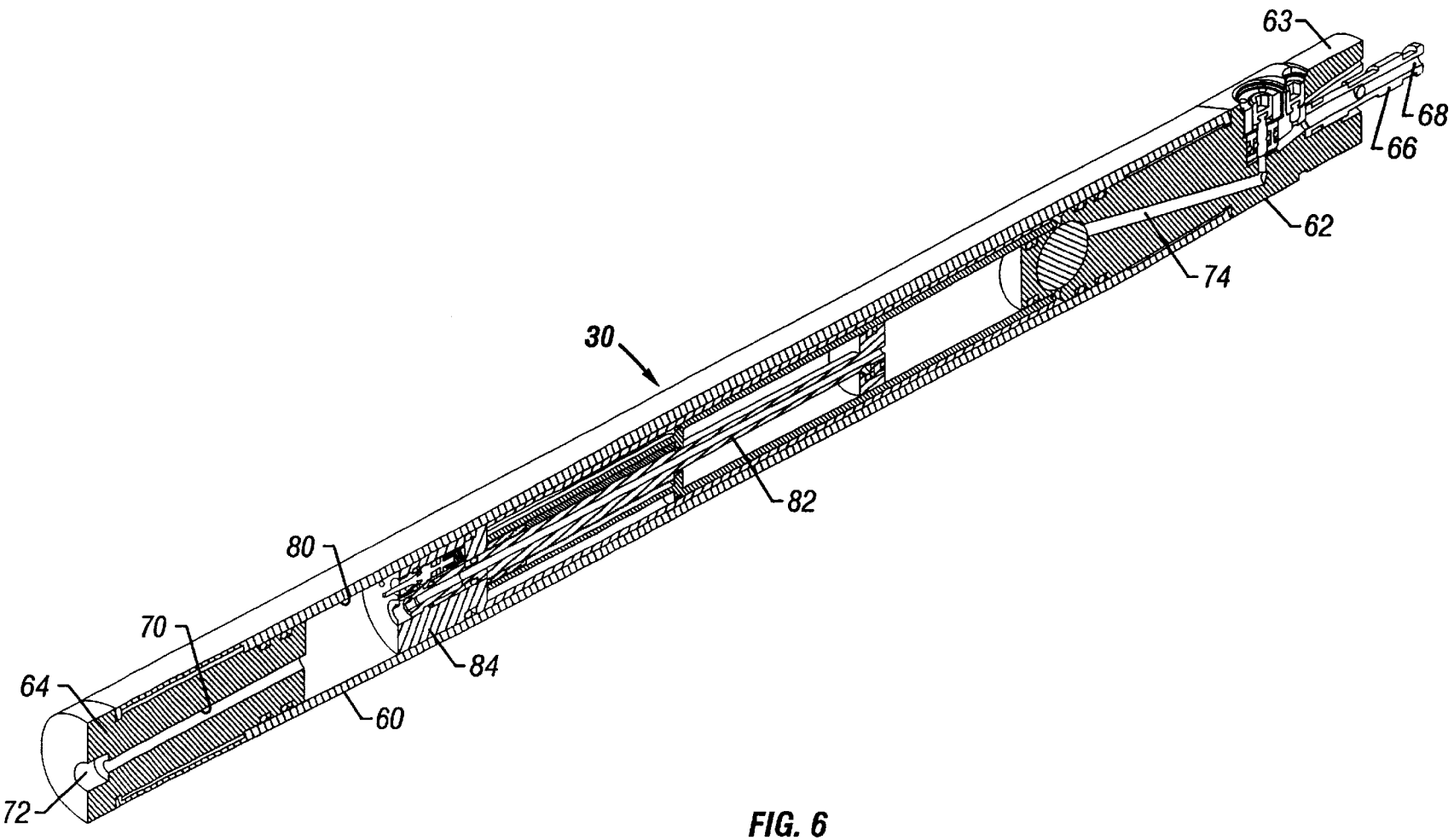
FIG. 6 is an axially sectioned isometric view of the invention.
Figure 7:
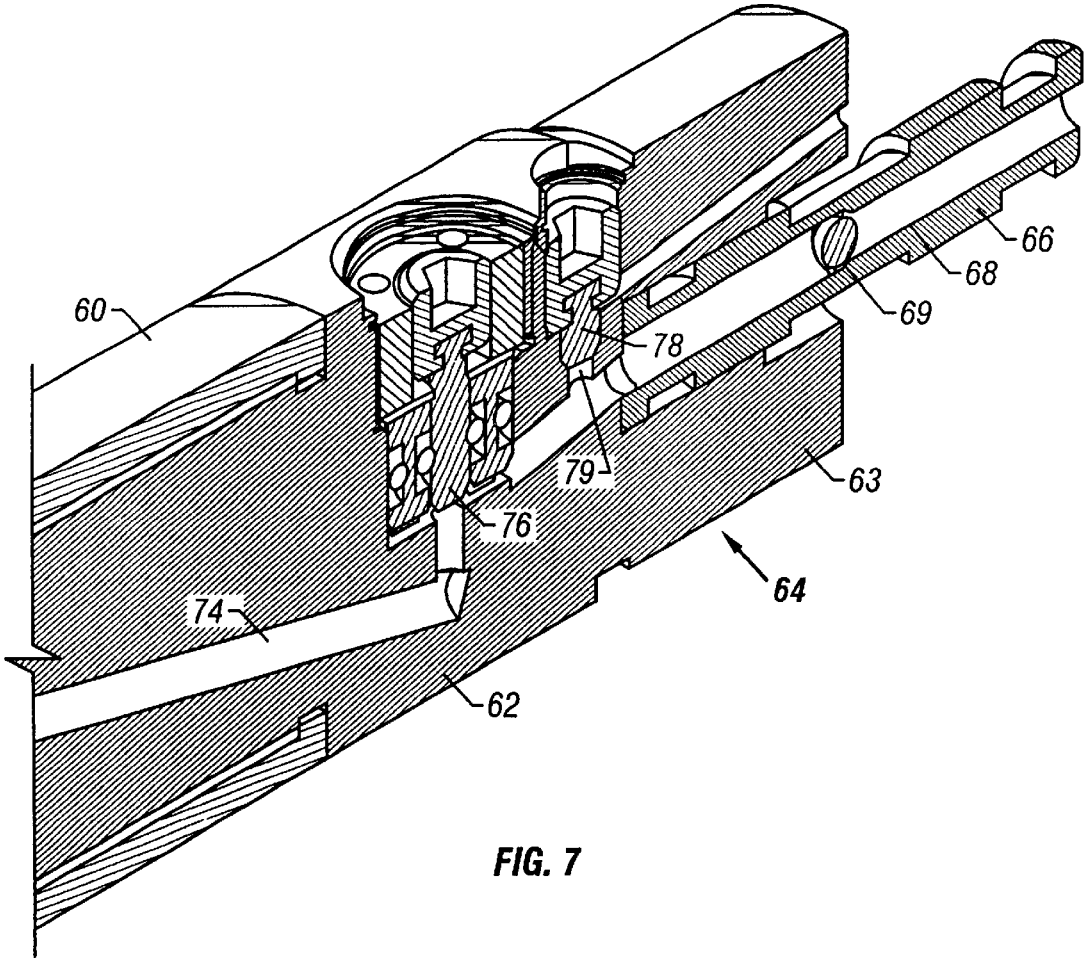
FIG. 7 is a sectioned detail of the sample inlet end of the invention.

FIGS. 5, 6 and 7 illustrate each tank 30 as comprising a cylindrical pressure housing 60 that is delineated at opposite ends by cylinder headwalls. The bottom-end headwall comprises a valve sub-assembly 62 having a socket boss 63 and a fluid conduit nipple 66 projecting axially therefrom. A conduit 68 within the nipple 66 is selectively connected by a respective conduit 54 to the tank distributor 49 and, ultimately, to the suction probe 22 of the formation fluid extractor 27. Fluid flow within the conduit 68 is rectified by a check valve 69. Within the valve sub-assembly 62 is a formation fluid flow path 74 between the conduit 68 and a formation fluid reservoir internally of the pressure housing 60. A solenoid actuated shut-off valve 76 is disposed to selectively open and close the channel of flow path 74. As best seen from the isometric detail of FIG. 7, a bleed valve 78 selectively closes a shunt conduit 79 that junctions with the flow path 74.

Figure 8:
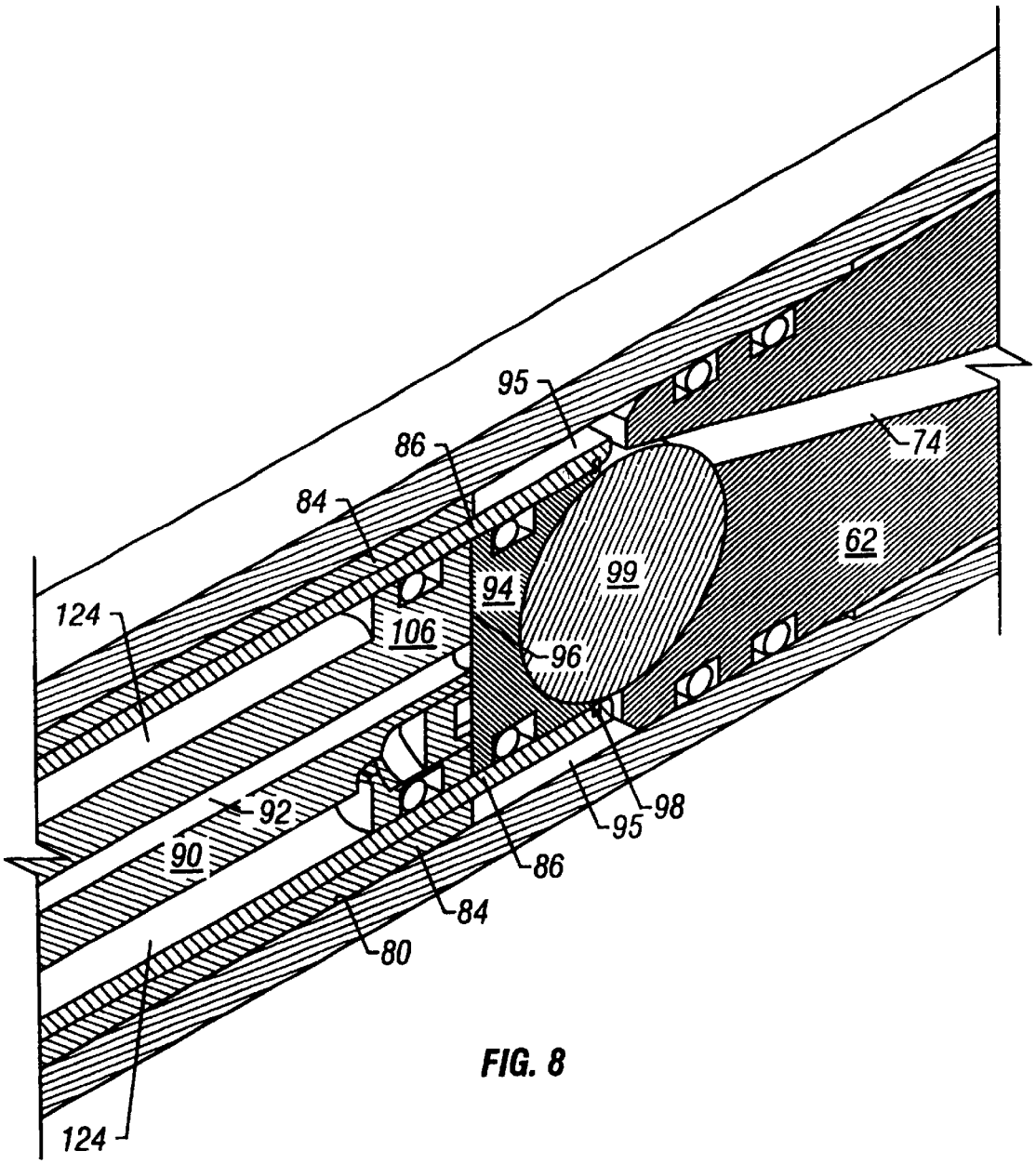
FIG. 8 is a sectioned detail of the sample chamber portion of the invention assembly.
Figure 9:
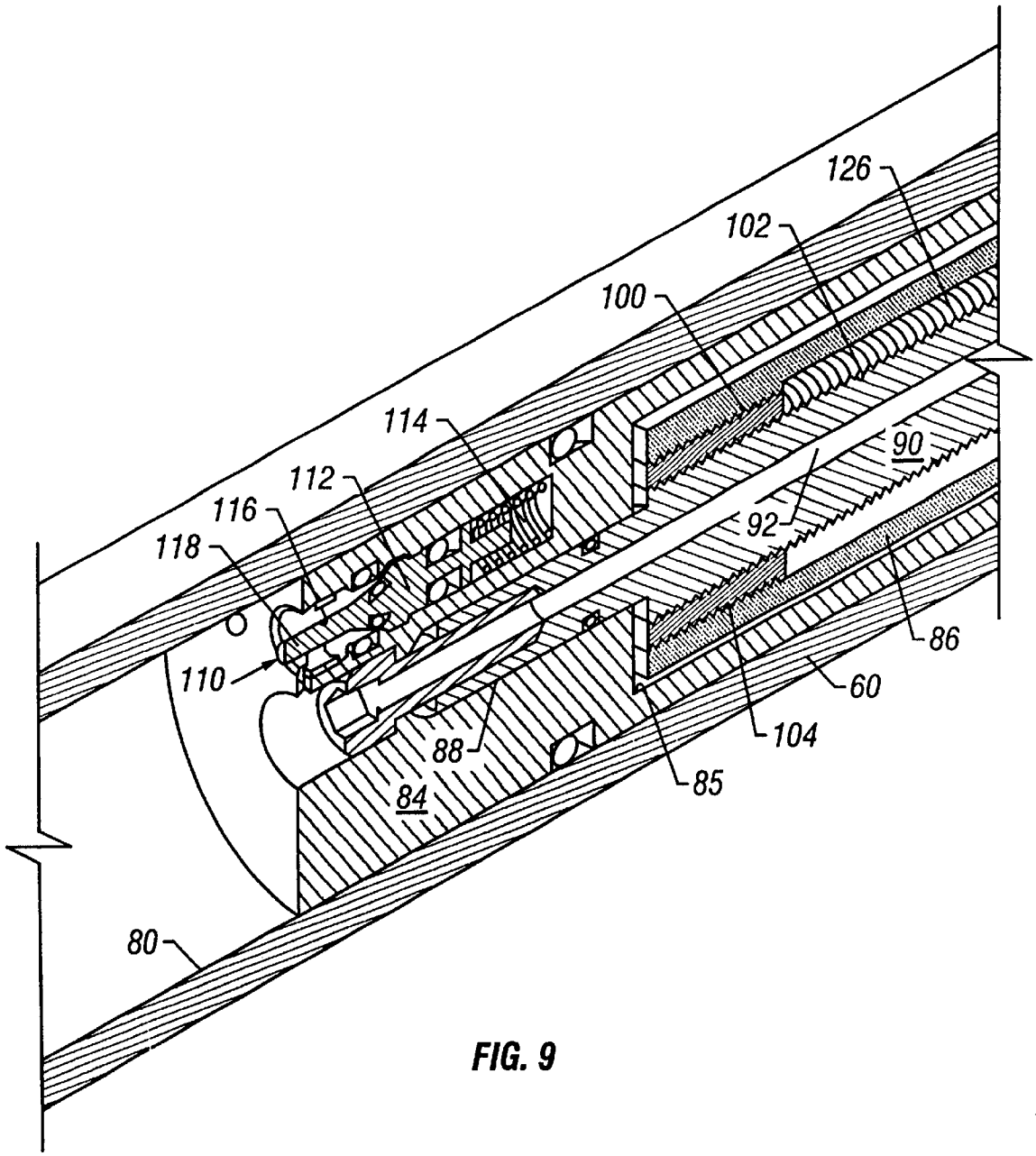
FIG. 9 is a sectioned detail of the hydrostatic wellbore pressure end of the compound piston.

Referring again to the axial half-section of FIG. 6, the pressure housing top-end headwall comprises a sub 64 having a fluid inlet conduit 70 that connects the interior bore 80 of the pressure housing 60 with a threaded tubing nipple socket 72. The conduit 70 is a normally open fluid flow path between the interior bore 80 and the in situ wellbore environment. Within the interior bore 80 of the pressure housing 60 is a traveling trap sub-assembly 82 that comprises the coaxial assembly of an inner traveling/locking sleeve 86 within an outer traveling sleeve 84 as shown by FIG.8. Unitized with the outer traveling sleeve 84 by a retaining bolt 88 as shown by FIG. 9, is a locking piston rod 90. A fluid channel 92 along the length of the rod 90 openly communicates the inner face 96 of a floating piston 94 with the open well bore conduit 70. The floating piston 94 is axially confined within the inner bore of the inner traveling/locking sleeve 86 by a retaining ring 98. A mixing ball 99 is placed within the sample (formation fluid) receiving chamber 95 that is geometrically defined as that variable volume within the interior bore 80 of pressure housing 60 between the valve sub-assembly 62 and the end area of the traveling trap sub-assembly 82.

A body lock ring 100 having internal barb rings 102 and external barb rings 104 selectively connects the rod 90 to the inner traveling/locking sleeve 86. The selective connection of the barbed lock ring 100 permits the sleeve 86 to move coaxially along the rod 90 from the piston 84 but prohibits any reversal of that movement.

Another construction detail of the inner traveling/locking sleeve 86 is the sealed partition 122 between the opposite ends of the sleeve 86. The chamber 124 created between the partition 122 and the piston head 106 of the rod 90 is sealed to the atmospheric pressure present in the chamber at the time of assembly.

The body lock ring 100 between the locking piston rod 90 and the inner bore wall of the inner traveling/locking sleeve 86 above the partition 122 does not provide a fluid pressure barrier. Consequently, the chamber 126 between the partition 122 and the body lock ring 100 functions at the same fluid pressure as the wellbore fluid flood chamber 120 when the flood valve 110 is opened.

Figure 11:
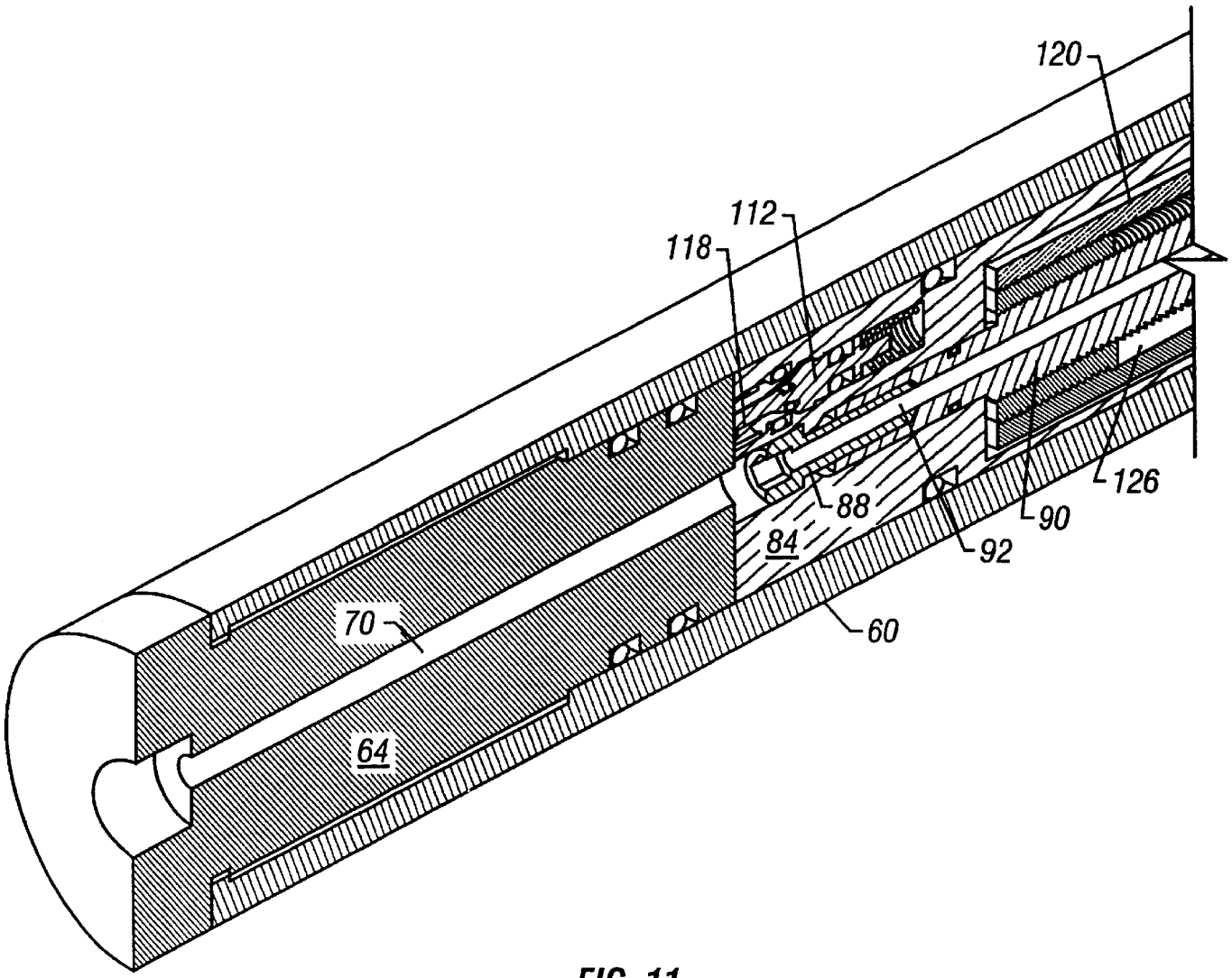
FIG. 11 is a sectioned detail of the compound piston position for wellbore fluid entry.
Figure 12:
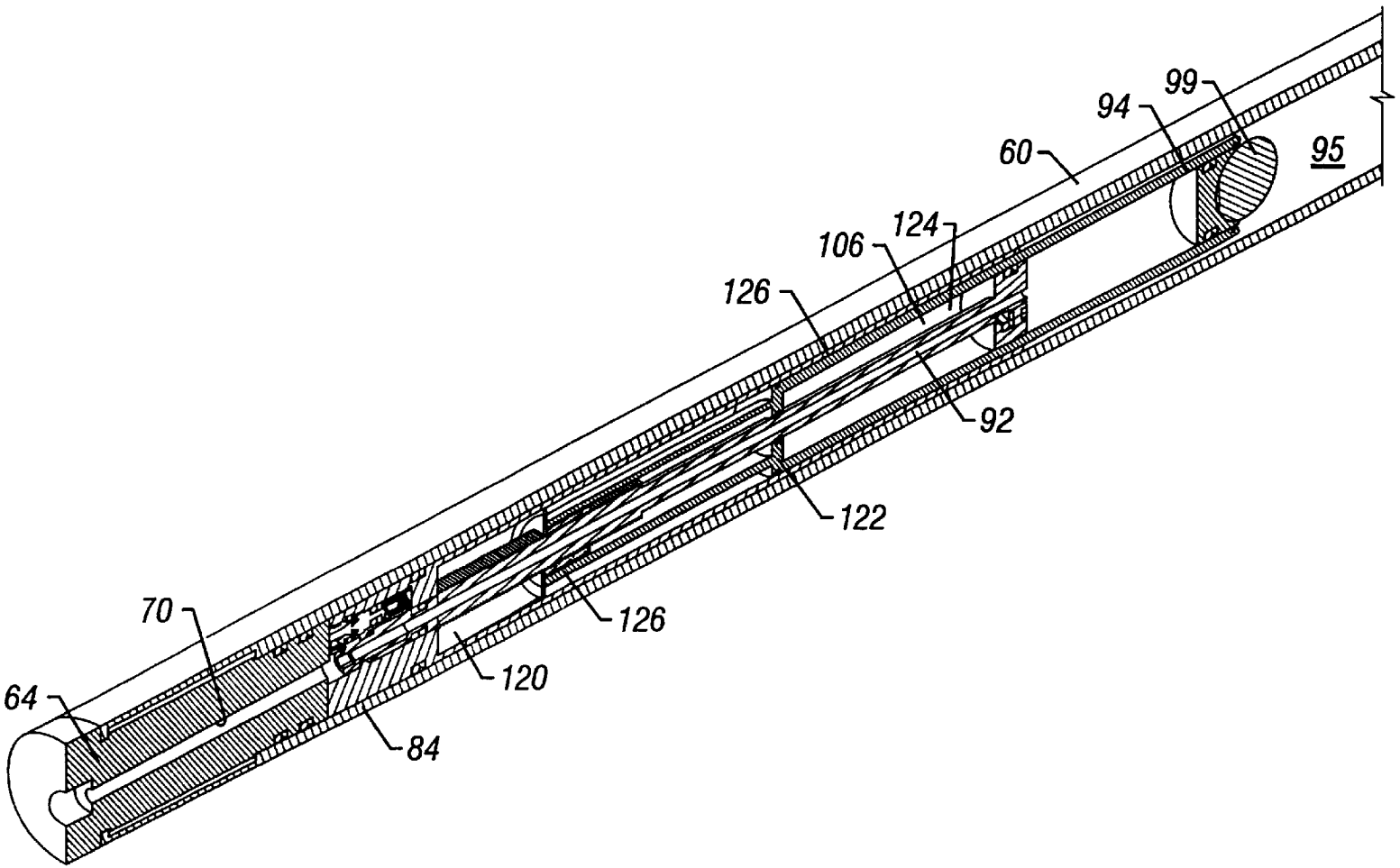
FIG. 12 is a sectioned detail of relative axial displacement between the elements of the compound piston.

Still with respect to FIG.9, the base of the floating piston/sleeve 84 includes a flood valve 110 having a pintle 112 biased by a spring 114 against a seal seat 116. The pintle includes a stem 118 that projects beyond the end plane of the floating piston/sleeve 84. When the end plane of the floating piston/sleeve 84 is pressed against the inner face of the top sub 64 (FIG. 11), the pintle 112 is displaced from engagement with the seal seat 116 to admit wellbore fluid into the flood chamber 120 as is illustrated by FIGS. 11 and 12. The flood chamber 120 is geometrically defined as the variable volume bounded by the annular space between the outer perimeter of the rod 90 and the inner bore 85 of the outer traveling sleeve 84.

OPERATION

Figure 3:
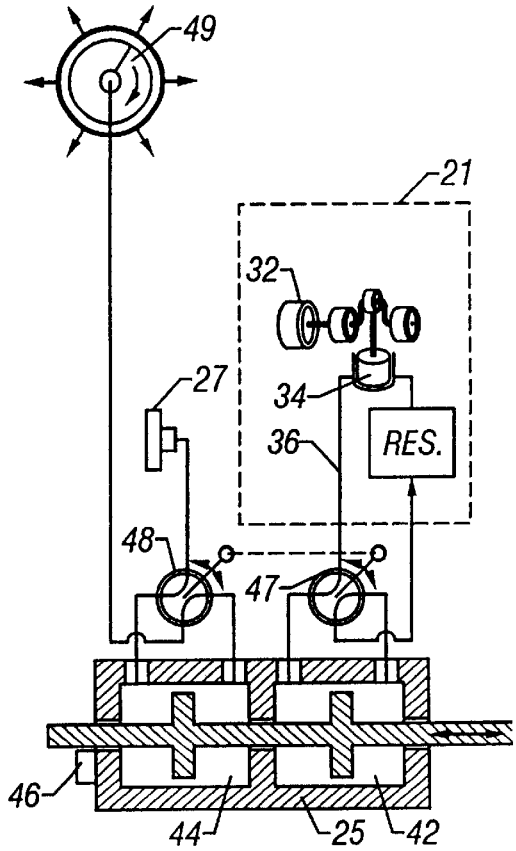
FIG. 3 is a schematic of a representative formation fluid extraction and delivery system.

Preparation of the sample tanks 30 prior to downhole deployment includes the closure of bleed valve 78 and the opening of shut-off valve 76. Under the power and control of instrumentation carried by the service truck 15, the sampling tool is located downhole at the desired sample acquisition location. When located, the hydraulic power unit 21 is engaged by remote control from the service truck 15. Hydraulic power from the unit 21 is directed to the formation fluid extractor unit 22 for borewall engagement of the formation fluid suction probe 27 and the borewall feet 28. The suction probe 27 provides an isolated, direct fluid flow channel for substantially pure formation fluid. Such formation fluid flow into the suction probe 27 is first induced by the suction of large volume pump 24 which is driven by the hydraulic power unit 21. The large volume pump 24 is operated for a predetermined period of time to flush the sample distribution conduits of contaminated wellbore fluids with formation fluid drawn through suction probe 27. When the predetermined line flushing interval has concluded, hydraulic power is switched from the large volume pump 24 to the small volume piston pump 25. Referring to FIG. 3, formation fluid drawn from the suction probe 27 by the pump 25 is shuttled by 4-way valve 48 into successively opposite chambers 44. Simultaneously, the valve 48 directs discharge from the chambers to a multiple port rotary valve 49, for example, which further directs the formation fluid on to the desired sample tank 30.

Figure 10:
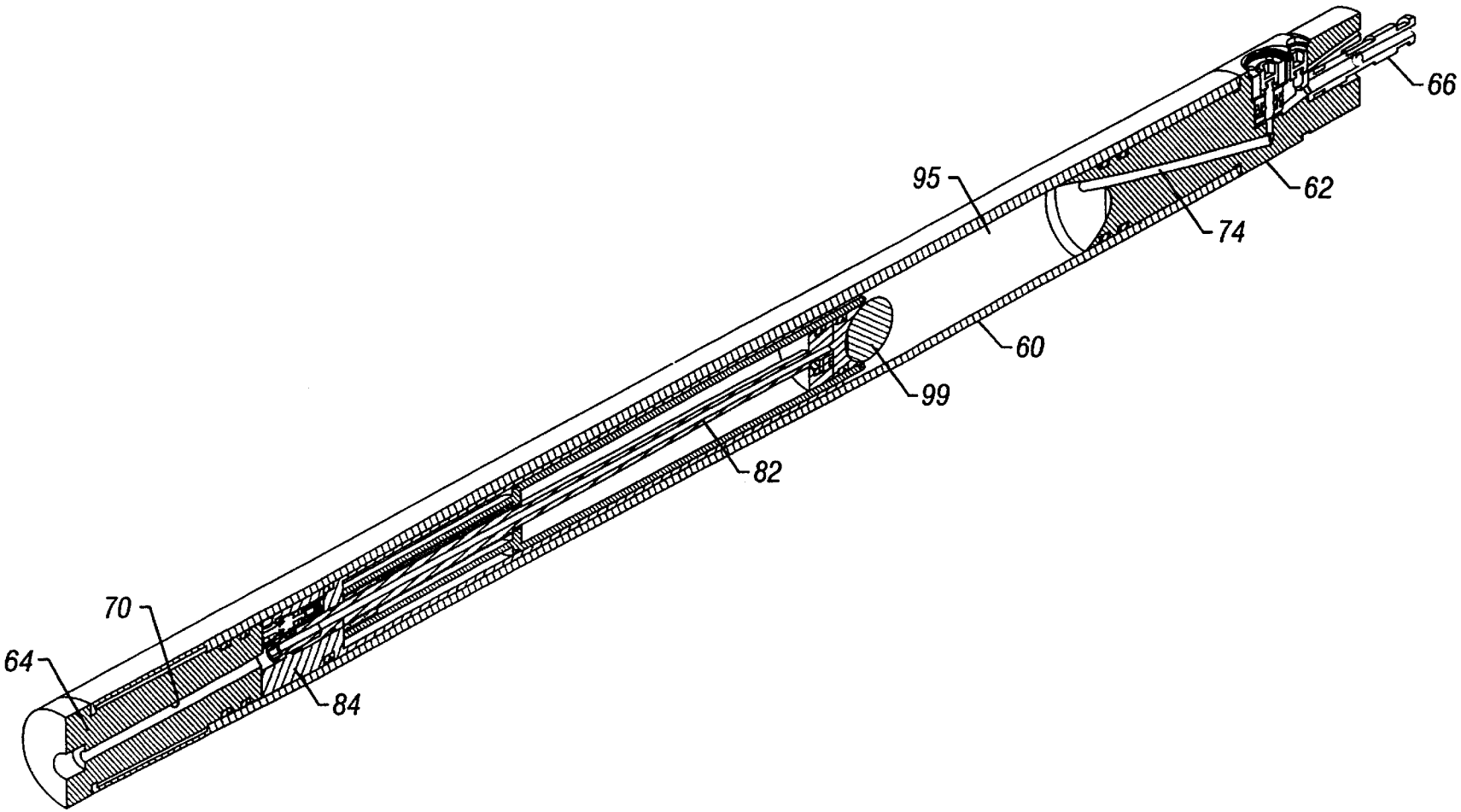
FIG. 10 is an axially sectioned isometric view of the invention in the course of receiving a sample of formation fluid.

Formation fluid enters the tank 30 through the nipple conduit 68 and is routed past the check valve 69 and along the flow path 74 into the sample receiving chamber 95. The tank shut-off valve 76 was opened before the tank was lowered into the wellbore. Pressure of the pumped formation fluid in the receiving chamber 95 displaces both, the outer traveling sleeve 84 and the inner traveling/locking sleeve 86, against the standing wellbore pressure in the interior bore 80 of pressure housing 60 as shown by FIG. 10. When the pressure of the formation fluid sample within the formation fluid sample chamber 95 reaches the boost pressure limit of pump 25, high pressure check valve closes to trap the sample of formation fluid within the sample chamber 30 and passage 32.

Also, when the sample receiving chamber 95 is full, the base plane of the outer traveling sleeve 84 will engage the inside face of the top sub 64. Thereby, the stem 118 is axially displaced to open the flood valve 110. Internal conduits within the outer traveling sleeve 84 direct wellbore fluid into the flood chamber 120. The wellbore pressure in the flood chamber 120 bears against the inneR traveling/locking sleeve 84 over the cross-sectional area of the flood chamber 120 annulus.

Opposing the flood chamber force on the traveling/locking sleeve 86 are two pressure sources. One source is the formation fluid pressure in the sample chamber 95 bearing on the annular end section of the traveling/locking sleeve 86 as was provided by the small volume pump unit 25. The other pressure opposing the flood chamber pressure is the closed atmosphere chamber 124 acting on the area of the annular partition 122. Initially, the force balance on the traveling/locking sleeve 86 favors the flood chamber side to press the annular end of the sleeve 86 into the sample chamber 95. Since the liquid formation fluid is substantially incompressible, intrusion of the solid structure of the sleeve 86 annulus into the sample chamber volume exponentially increases the pressure in the sample chamber until a final force equilibrium is achieved. Nevertheless, at the pressures of this environment, measurable liquid compression may be achieved.

This axial movement of the inner traveling/locking sleeve 86 relative to the outer sleeve 84 also translates to the piston rod 90 which is secured to the outer sleeve 84 via the retaining bolt 88. Consequently, the sleeve 86 partition 122 is displaced toward the piston head 106 to compress the gaseous atmosphere of chamber 124 thereby adding to the equilibrium forces.

Due to the internal and external barb rings 102 and 104 respective to the body lock ring 100, movement of the piston 90 relative to the inner traveling sleeve 86 is rectified to maintain this volumetric invasion of the structure 86 into the sample chamber volume.

By compressing the volume of the formation fluid sample, the fluid sample pressure is greatly increased above the wellbore pressure. Although this greatly increased in situ pressure declines when the confined formation sample is removed from the wellbore, the operative components may be designed so that when the collected formation sample is removed from the well, the sample pressure does not decline below the bubble point of entrained or dissolved gas. Movement of the inner traveling/locking sleeve 86 further compresses the collected formation fluid sample above the boost capability of the pump 25. Such compression continues until the desired boost ratio is accomplished.

For example, a down hole fluid sample can have a hydrostatic wellbore pressure of 10,000 psi. The typical compressibility for such a fluid is $5\times10^{-6}$ so that a volume decrease of only eight percent would raise the fluid sample pressure by 16,000 psi to 26,000 psi, for a boost ratio os 2.6 to 1.0. When the magazine section 26 and the collected formation fluid sample is raised to the surface of wellbore 11, the formation fluid sample temperature will cool, thereby returning the formation fluid sample pressure toward the original pressure of 10,000 psi. If the downhole fluid temperature is 270° F. and the wellbore 11 surface temperature is 70° F., the resulting 200° drop in temperature will lower the fluid sample pressure by approximately 15,300 psi in a fixed volume, thereby resulting in a surface fluid sample pressure of approximately 10,700 psi.

To hold the volume of fluid sample chamber 95 constant as the magazine 26 is removed from the wellbore 11, inner traveling/locking sleeve 86 is fixed relative to outer traveling sleeve 84 during retrieval of the magazine 26. The invention accomplishes the fixed relationship by means of the body lock ring 100. This mechanism permits additional boost to be added to the formation fluid sample pressure within the sample chamber 95 as a proportionality of the in situ wellbore pressure. For example, the magazine section 26 may subsequently be lowered to additional depths within a wellbore 11 where the hydrostatic pressure is greater than a prior sample extraction. The hydrostatic wellbore pressure increase is transmitted through flood valve 112 into flood chamber 120 to further move the inner traveling/locking sleeve 86 and to further compress the formation fluid sample within the sample chamber 95 to a greater pressure. Such pressure boost may be accomplished quickly and magazine 26 removed to the surface of wellbore 11 before a significant amount of heat from the additional wellbore depth is transferred to the previously collected formation fluid sample.

At the surface of wellbore 11, tank shut-off valve 76 is closed to trap the formation fluid sample. Thereafter, bleed valve 78 may be opened to relieve the fluid pressure in the flow passage between tank shut-off valve 76 and the high pressure check valve 69. This pressure release provides a positive indication of fluid pressure and facilitates removal of a tank 30 from a magazine 26.

Figure 13:
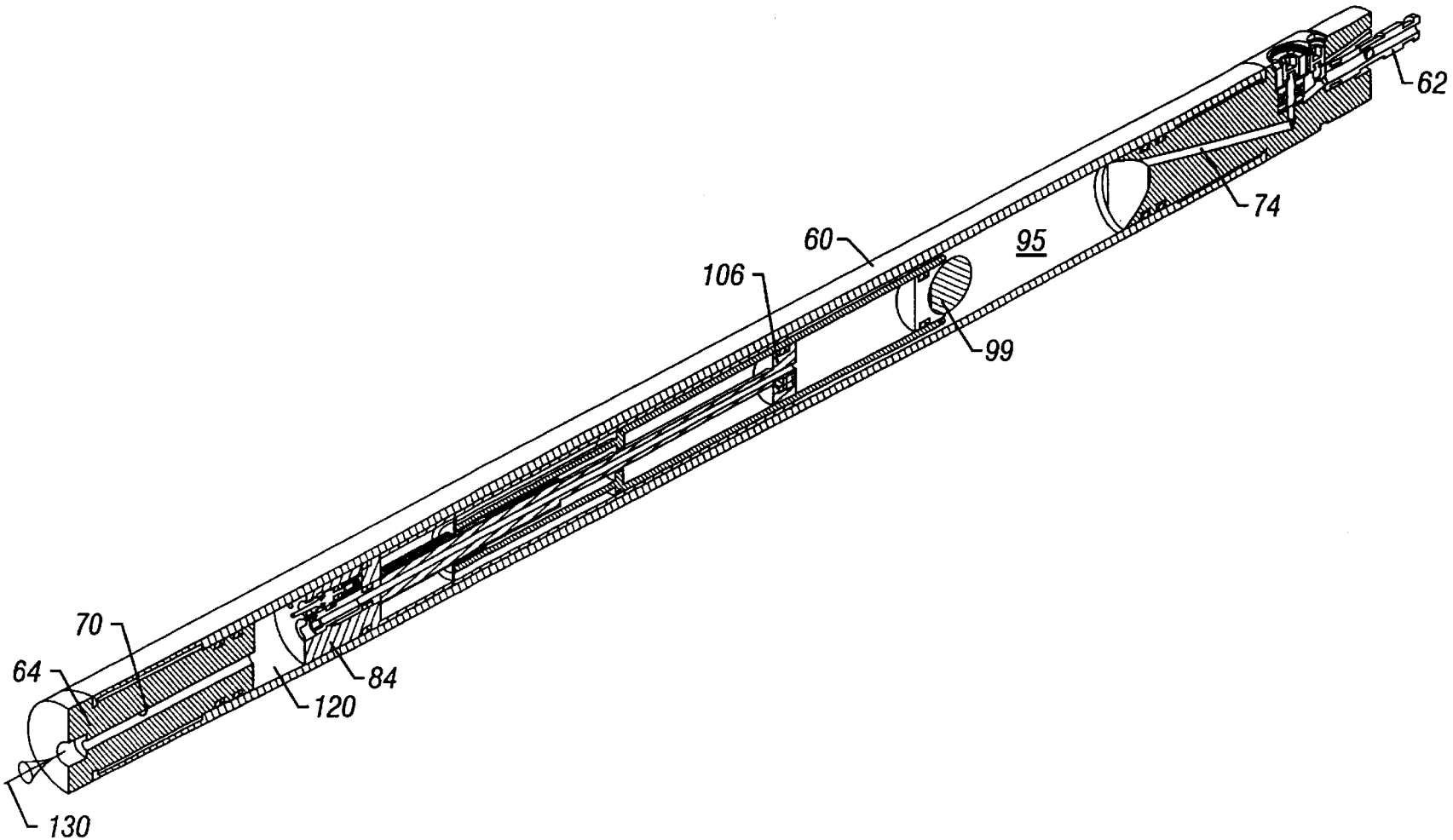
FIG. 13 is an axially sectioned view of the invention in the course of sample extraction; and, FIG. 14 is an orthographic axial section of the invention.
Figure 14:
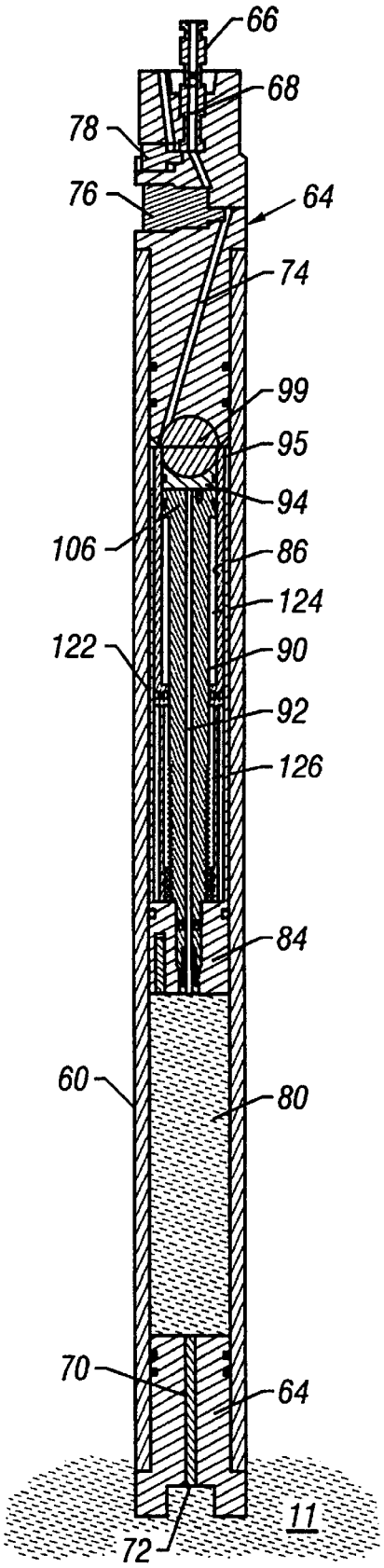

FIG. 13 illustrates one technique for removing the formation fluid sample under pressure from within fluid sample chamber 95. Tank 30 is connected to a pressure source 130 engaged with aperture 132 through top sub 64. Pressure from the pressure source 130 is introduced until the inverse of the boost ratio times the expected pressure within fluid sample chamber 95 is reached. For a fluid sample pressure of 10,000 psi, the extraction pressure required would be:

$$1/2.6\times10{,}000=3{,}850 \text{ psi}$$

After the inverse boost ratio is reached, shut-off valve 76 is cracked open and the formation fluid sample is permitted to pass through passage 74 into an attached receiver line 140. The reverse boost pressure can be increased to displace the collected formation fluid sample until the sleeve edge of the inner traveling/locking sleeve 86 bottoms out against the valve sub 62. Continued extraction fluid from the pressure source 130 displaces the outer traveling sleeve 84 relative to the inner sleeve 86. Hence, the piston head 106 engages the floating piston 94 to sweep most of the formation fluid sample from the chamber 95. The only volume within the chamber 95 not removed by the extraction pressure is found in an annular space between the outer traveling sleeve 84 and the valve sub 62. The components of tank 30 can be dissembled and reset for another use.

In summary, the invention permits multiple tanks 30 to be lowered in the same operation so that different zones within wellbore 11 can be sampled. Each tank can be selectively operated to collect different samples at different pressures and to compress each sample to different rates exceeding the bubble point for gas within the sample. Operating costs are significantly reduced because less rig time is required to sample multiple zones. The invention prevents the pressure within each fluid sample from being reduced below the bubble point therefore delivering each fluid sample to the wellbore surface in substantially the same pressure state as the downhole sampling state. The invention accomplishes this function without requiring expanding gases, large springs and complicated mechanical systems. The fluid sample is collected under pressure and additional pressure is added with a force exerted by the downhole hydrostatic pressure.

Although the invention has been described in terms of certain preferred embodiments, it will become apparent to those of ordinary skill in the art that modifications and improvements can be made to the inventive concepts herein without departing form the scope of the invention. The embodiments shown herein are merely illustrative of the inventive concepts and should not be interpreted as limiting the scope of the invention.

What is claimed is:

1. An apparatus for controlling pressure on a pressurized sample of formation fluid collected downhole in a well, comprising:

a housing having a hollow interior;

a piston within said housing interior for defining a fluid sample chamber, wherein said piston is moveable within said housing interior to selectively change said fluid sample chamber volume;

a pump for delivering a sample volume of formation fluid into said fluid sample chamber by displacement of said piston in a first direction; and, a valve that is operatively responsive to movement of said piston in said first direction for admitting pressurized wellbore fluid against said piston to bias movement of said piston in a second direction wherein said second direction piston movement pressurizes the fluid sample within said fluid sample chamber so that the formation fluid sample remains pressurized when the fluid sample is moved to the well surface.

2. An apparatus as recited in claim 1, further comprising a check valve engaged between said pump and said fluid sample chamber for preventing second direction piston movement from forcing the formation fluid sample toward said pump.

3. An apparatus as recited in claim 1, wherein said valve is attached to said piston.

4. An apparatus as recited in claim 1, further comprising a tank shut-off valve engaged between said pump and said fluid sample chamber for selectively permitting said formation fluid sample to be pressure isolated from said pump.

5. An apparatus as recited in claim 1, further comprising a lock for securing said piston at a position of second direction displacement relative to said housing to maintain the volume of said fluid sample chamber.

6. An apparatus as recited in claim 1, wherein said piston includes an outer sleeve and an inner sleeve moveable relative to said outer sleeve, and wherein said valve is operative to admit the pressurized wellbore fluid to contact said inner sleeve for moving said inner sleeve relative to said outer sleeve to pressurize the formation fluid sample.

7. An apparatus as recited in claim 6, further comprising a lock for securing said inner sleeve at a position displaced in said second direction relative to said outer sleeve to maintain the volume of said fluid sample chamber.

8. An apparatus as recited in claim 6, further comprising a flood chamber between said inner sleeve and said outer sleeve for receiving the pressurized wellbore fluid so that the wellbore fluid exerts a differential pressure against said inner sleeve to move said inner sleeve relative to said outer sleeve.

9. An apparatus as recited in claim 8, further comprising an atmospheric chamber between said inner sleeve and said outer sleeve, said atmospheric chamber initially having a pressure less than hydrostatic wellbore pressure and which is reduced in volume as said inner sleeve moves relative to said outer sleeve.

10. An apparatus as recited in claim 1, further comprising a second housing and piston engaged with said pump to define a second formation fluid sample chamber for selectively pressurizing a second sample of formation fluid to a different pressure than the fluid pressure within the first formation fluid sample chamber.

11. An apparatus for controlling pressure on a pressurized formation fluid sample collected downhole in a well, comprising:

a housing having a hollow interior;

a piston within said housing interior for defining a fluid sample chamber, wherein said piston is moveable within said housing interior to selectively change said fluid sample chamber volume, and wherein said piston comprises an outer sleeve and an inner sleeve moveable relative to said outer sleeve;

a pump for introducing a formation fluid sample under pressure into said fluid sample chamber;

retainer means for securing a displaced position of said piston outer sleeve relative to said housing; and, a valve for selectively admitting pressurized wellbore fluid against said piston to displace said piston inner sleeve relative to said piston outer sleeve so that formation fluid in said fluid sample chamber is compressed.

12. An apparatus as recited in claim 11, further comprising a valve for selectively blocking fluid communication between said pump and said fluid sample chamber.

13. An apparatus as recited in claim 12, wherein said valve comprises a check valve.

14. An apparatus as recited in claim 11 wherein said retainer means comprises a body lock ring for securing said piston inner sleeve at a displaced position relative to said housing.

15. A method for controlling pressure on a pressurized formation fluid sample from a wellbore, comprising:

lowering a housing into the wellbore, wherein said housing has a piston within a hollow interior of said housing which is moveable to define a fluid sample chamber;

pumping formation fluid into said fluid sample chamber to collect a formation fluid sample;

operating a valve to introduce wellbore fluid at a downhole hydrostatic pressure into contact with said piston to move said piston for pressurizing the formation fluid sample within said fluid sample chamber;

retaining the formation fluid sample within said fluid sample chamber as said piston moves to compress the well fluid sample within said fluid sample chamber;

locking said piston relative to said housing to fix the volume of the formation well fluid sample within said fluid sample chamber when the well fluid reaches a selected pressure above the downhole hydrostatic pressure; and, withdrawing said housing from said wellbore.

16. A method as recited in claim 15, further comprising the step of removing the formation fluid sample from said fluid sample chamber while maintaining the pressure of the formation fluid sample above a selected pressure.

17. A method as recited in claim 15, further comprising the step of moving said housing to a second location within the wellbore after said piston is locked relative to said housing, and further comprising the steps of pumping a second formation fluid sample into a second fluid chamber respective to a second housing, of operating a corresponding second valve to move a corresponding second piston to compress the second fluid sample, and of locking said second piston relative to said second housing to fix the volume of the second formation fluid sample.

18. A method as recited in claim 17, wherein a second hydrostatic pressure respective to said second location compresses the second formation fluid sample to a pressure greater than the pressure of the first formation fluid sample.

19. A method as recited in claim 15, further comprising the step of lowering said housing within the wellbore so that a greater hydrostatic fluid pressure within said wellbore additionally moves said piston to further compress the formation well fluid sample before said housing is withdrawn from said wellbore.

20. A method as recited in claim 15, wherein said piston compresses the formation fluid sample to a pressure so that the formation fluid sample does not change phase when said housing is withdrawn from the wellbore.

21. A process for transferring a sample of earth formation fluid from a downhole production depth to a wellbore surface, said process comprising:

(a) lowering a unitized assembly of downhole tools into a wellbore, said assembly including a formation fluid extraction tool, a formation fluid sample retrieval tank and a surface controlled pump for selectively charging said sample retrieval tank with formation fluid;

(b) positioning said fluid extraction tool at a first wellbore depth;

(c) extracting formation fluid at said first wellbore depth;

(d) charging a first sample volume in said sample retrieval tank with a corresponding volume of the first depth formation fluid;

(e) applying in situ wellbore pressure to an element of said sample retrieval tank to reduce the first sample volume of said first sample tank to a second sample volume less than said first sample volume without displacement of fluid from said sample retrieval tank whereby the first sample volume of first depth formation fluid is compressed to a pressure substantially greater than said in situ wellbore pressure;

(f) structurally securing said second sample volume; and, (g) retrieving the downhole tool assembly to the wellbore surface.

22. A process as described by claim 21 wherein said downhole tool assembly includes a second sample retrieval tank and said process further comprises:

(a) repositioning said formation extraction tool to a second wellbore depth prior to surface retrieval of said tool assembly;

(b) extracting formation fluid at said second wellbore depth;

(c) charging a first sample volume of said second sample retrieval tank with second depth formation fluid;

(d) applying said second in situ wellbore pressure to an element of said second sample retrieval tank to reduce the first sample volume thereof to a second sample volume less than said first sample volume without displacement of fluid from said second sample retrieval tank whereby the first sample volume of second depth formation fluid is compressed to a pressure substantially greater than said second in situ wellbore pressure; and, (e) structurally securing said second enclosed volume of said second sample retrieval tank.

23. A process as described by claim 21 wherein said structural component of said sample retrieval tank is provided less effective pressure area within said first enclosed volume than effective pressure area receiving said wellbore pressure.

24. A process for extracting a sample of earth formation fluid comprising:

(a) preparing a sample retrieval tank with a variable volume sample chamber;

(b) placing said sample retrieval tank in a wellbore;

(c) filling, in situ, a first volume of said sample chamber with a first volume of formation fluid;

(d) applying in situ wellbore pressure against a structural component of said sample retrieval tank to reduce said sample chamber to a second volume less than said first volume without displacement of fluid from said sample chamber whereby said formation fluid therein is compressed to a pressure substantially greater than said in situ wellbore pressure;

(e) securing the second volume position of said structural component; and, (f) removing said sample retrieval tank from said wellbore.

25. A process as described by claim 24 wherein said structural component is a moveable partition between in situ wellbore fluid and formation fluid within said sample chamber.

26. A process as described by claim 24 wherein the in situ wellbore pressure applied against said structural component displaces said component into said sample chamber to reduce the chamber volume thereof.

27. A process as described by claim 26 wherein said in situ wellbore fluid bears upon a greater area of said structural component than formation fluid within said sample chamber.

28. An apparatus for retrieving a sample of earth formation fluid from a wellbore comprising:

(a) a cylinder having a moveable piston therein to define a variable volume sample chamber, said piston having relatively moveable first and second pressure bearing elements, each of said pressure bearing elements having respective sample chamber pressure bearing areas and wellbore pressure bearing areas wherein the wellbore pressure bearing area of said second pressure bearing element is greater than the sample chamber pressure bearing area of said second pressure bearing element;

(b) a pump for extracting fluid from an earth formation and for discharge of said fluid through a transfer conduit into said sample chamber;

(c) a first valve in said transfer conduit for preventing fluid flow reversal from said sample chamber; and, (d) a second valve for admitting wellbore fluid against the wellbore pressure area of said second pressure bearing element, said second valve being positioned on said first pressure bearing element and operable by arrival of said first pressure bearing element at a position corresponding to a maximum sample chamber volume.

29. An apparatus as described by claim 28 wherein said first and second pressure bearing elements include coaxially moveable first and second sleeve members, respectively, the second sleeve member being moveable within the first sleeve member.

30. An apparatus as described by claim 29 wherein said first and second sleeve members have mutually engaged barb members to rectify relative displacement between said sleeve members.

31. An apparatus as described by claim 30 wherein the wellbore pressure bearing area of said first pressure bearing element comprises a substantially continuous piston face across one end of said first sleeve member, said valve being disposed within said piston face.

32. An apparatus as described by claim 29 wherein said cylinder is terminated at opposite ends by respective end walls whereby said variable volume sample chamber is expanded by displacement of said piston along said cylinder toward a first end wall.

33. An apparatus as described by claim 32 wherein said second valve is positioned on said first sleeve member to be opened by proximity of said piston with said first cylinder end wall.

34. An apparatus as described by claim 33 wherein said second valve admits wellbore fluid between said first and second sleeve members to axially displace said second sleeve member relative to said first sleeve member.

35. An apparatus as described by claim 34 wherein said first and second sleeve members include a cooperative displacement rectifier whereby the displacement of said second sleeve member relative to said first sleeve member is unidirectional.

* * * * *